US005623125A

United States Patent [19]

Pioch

[11] Patent Number: 5,623,125

[45] Date of Patent: Apr. 22, 1997

[54] ROD BUSHING FOR AN ELECTRICAL TRANSFORMER

[75] Inventor: Olivier Pioch, Nice, France

[73] Assignee: Pioch, Carros cedex, France

[21] Appl. No.: 426,179

[22] Filed: Apr. 21, 1995

[30] Foreign Application Priority Data

Apr. 21, 1994 [FR] France ..... 94 05058

[51] Int. Cl.[6] ..... H01B 17/26

[52] U.S. Cl. ..... 174/152 R; 174/153 R; 174/DIG. 10

[58] Field of Search ..... 174/151, 152 R, 174/153 R, 12 BH, DIG. 10, 11 BH, 14 BH, 15.3

[56] References Cited

U.S. PATENT DOCUMENTS

| | | | |
|---|---|---|---|
| 2,788,386 | 4/1957 | McCarty | 174/153 R |
| 3,825,320 | 7/1974 | Redfern | 174/152 R X |
| 4,025,714 | 5/1977 | Quick et al. | 174/153 R X |
| 4,956,525 | 9/1990 | Wilk | 174/152 R |

FOREIGN PATENT DOCUMENTS

| | | | |
|---|---|---|---|
| 846750 | 9/1939 | France | 174/153 R |

*Primary Examiner*—Hyung S. Sough
*Attorney, Agent, or Firm*—Reid & Priest LLP

[57] ABSTRACT

A post-mounted device for mounting over an electrical transformer output post extends through an orifice in a wall of the electrical transformer with the post-mounted device having a body positioned on a first side of the wall and a cover positioned on a second side of the wall, with fasteners used to clamp the wall between the body and the cover. The post-mounted device includes a portion that restricts pivotal motion of the cover relative to the wall and a gasket provided in this portion seals the cover against the wall. The cover also includes a stepped cylindrical opening at an end of the cover opposite from the end of the cover that seals against the wall, with the stepped cylindrical opening containing a gasket in its smaller diameter portion for radially sealing against the output post, and a stepped spacer that is partially contained within the smaller diameter portion and partially contained within the larger diameter portion of the stepped cylindrical opening. Elastic washers are provided within the larger diameter portion of the stepped cylindrical opening in the cover in order to provide a compressive load against the stepped spacer.

11 Claims, 3 Drawing Sheets

ROD BUSHING FOR AN ELECTRICAL TRANSFORMER

The present invention concerns a post-mounted device for electric power apparatuses, in particular transformers.

The state of the art already encompasses post-mounted devices designed to be fastened to a low-voltage output post of a transformer. This component has an electrical function, i.e., that of sending the transformer output current from the output windings located within the transformer casing to external electric circuits, while at the same time providing faultless electrical insulation between the conductor post pin and the casing. To carry out this electrical function with complete safety over many years, a post-mounted device must also possess mechanical strength when being subjected to operating temperatures of up to 250° C., to vibrations, and to static stresses resulting from the assembly or use of the device.

Accordingly, conventional post-mounted devices generally incorporate a skirt-shaped cover made of a ceramic or a thermo-hardened epoxy material and fitted with an annular area which passes through an orifice provided in the wall of a transformer, and an annular body positioned on the other side of the wall from the cover, this body working in conjunction with the cover so as to clamp the transformer wall, thereby forming a mechanically strong assembly which is electrically insulated from the conductor post. Furthermore, the unit is made solid by virtue of adjusting nuts screwed on the ends of the output post.

Conventional post-mounted devices do not always sufficiently withstand the sometimes contrary stresses to which they are subjected. Thus, the durability of the unit requires a relatively heavy, rigid component; but this requirement is contradicted by the need to drill in the transformer wall only insertion holes having a restricted diameter, or by the need for a degree of flexibility in order to facilitate assembly of the post-mounted device. Moreover, because of the fact that transformers generally contain a fluid at high temperature, such as an oil or gas, the device must possess a high level of impermeability over long periods of use.

Given the requirements cited above, the post-mounted devices according to the state of the art possess a number of disadvantages. These elements, which have a body and a cover made of a ceramic, exhibit good resistance to high temperatures, but very bad resistance to pronounced mechanical stresses, impacts, and vibrations, especially because they are heavy and bulky. In addition, conventional post-mounted devices incorporate visible gaskets, whose durability over time is limited by external attacks of all kinds, i.e.: corrosion, dust, ultraviolet radiation, and other agents. Furthermore, the relative flexibility of these gaskets allows the cover of the device to swivel to a degree in relation to the body and to the post, a fact which may produce localized stresses on the porcelain cover and the deterioration thereof, while increasing the risk of penetration of dust or other polluting agents between the base of the cover and the transformer wall.

Given this state of the art, the invention is intended to supply a post-mounted device which eliminates the disadvantages mentioned above and proposes a completely impermeable structure possessing enhanced mechanical strength.

To this end, the invention relates to a post-mounted device, in particular for an electric transformer, placed over a transformer outlet post at a hole drilled in the wall thereof, said device incorporating a body positioned on a first side of the wall and a cover positioned on a second side of this wall, and fastening means allowing this wall to be clamped between said body and said cover, this device being characterized by the fact that it comprises protection means capable of restricting the pivoting motion of the cover and/or of the body and of improving the impermeability of the attachment between the wall and the cover and/or the body.

According to a first, advantageous embodiment, the cover and/or the body is made from a plastic material, and the protection means are produced as an annular shoulder provided in the base of the cover and of the body, this annular shoulder being fitted with an annular groove capable of housing respective gaskets arranged so as to be insulated from the ambient air when the post-mounted device is mounted. The plastic material is, in particular, a polybutylene terephthalate or a polyamide, especially a polyaimide.

In accordance with other advantageous features of this embodiment:

the cover incorporates a cylindrical cavity whose diameter is equal to the diameter of the orifice in the transformer wall, and the body incorporates a cylindrical, annular projection whose height is greater than the thickness of the wall and whose interior diameter matches the diameter of the post, the exterior diameter being substantially equal to the diameter of the orifice cut in the wall, so that, when the device is mounted on either side of the wall, the outer face of the aforementioned projection acts as an element used to center the body and the cover over the orifice in the wall;

in an upper face separated by a distance from the wall, the cover comprises a cylindrical opening centered on the axis of the cover and made deep enough to house at least one elastic clamping washer, in particular one made of copper-beryllium;

the cylindrical opening exists in the form of two juxtaposed coaxial cylinders, i.e., a first large-diameter cylinder located in proximity to the aforementioned upper face and designed to house one or several clamping washers, and a second cylinder of smaller diameter designed to house a gasket and a spacer;

the aforementioned spacer has a radial portion extending into said first cylinder, and an axial portion located in said second cylinder;

this spacer is made of a plastic material, most notably polybutylene terephthalate reinforced with glass fibers;

the gasket is made of a carbon-containing, fluorinated elastomer material, teflon, or silicone.

According to another, simplified embodiment of the invention, the cover is made of porcelain and the protection means are produced as a spacer mounted between the base of the cover and the transformer wall. This spacer incorporates a support tongue inserted between the base of the cover and the wall and a lip substantially perpendicular to the support tongue and made slightly elastic, so as to clamp the lateral face of the base of the cover.

The invention will be described in greater detail below with reference to the attached drawings, provided solely as non-limiting examples and in which.

It should be noted that the invention is described as one example in connection with the use thereof in an electrical transformer, it being understood that the invention can be used in any other field in which a conductor post must extend from a first medium under high temperature to a second medium, while ensuring the insulation thereof.

Figure 1:
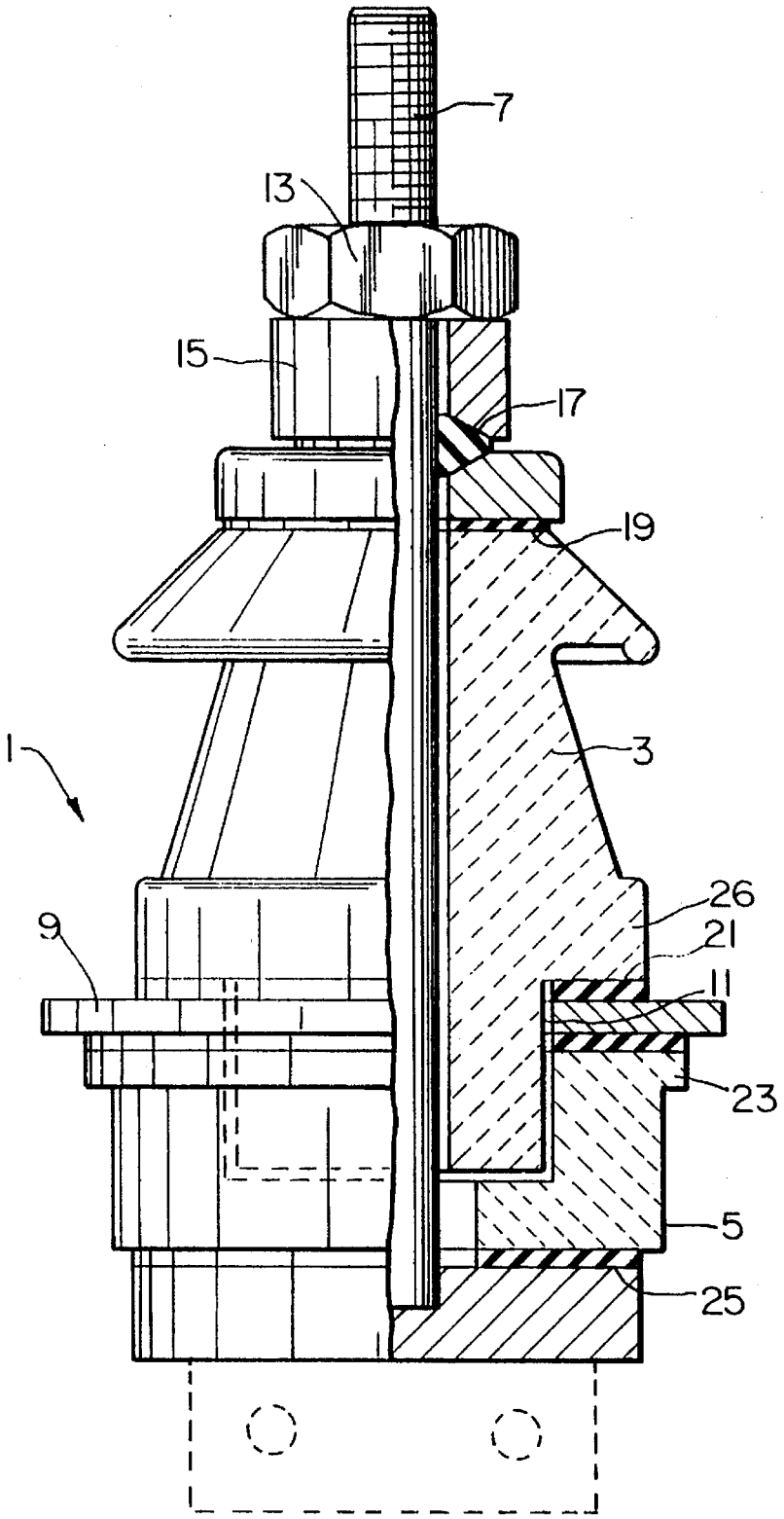
FIG. 1 PRIOR ART
FIG. 1 is a raised view in cross-section of a post-mounted device according to the state of the art.

Reference is made to FIG. 1, which illustrates a conventional post-mounted device 1 composed mainly of a cover 3 and of a body 5 arranged on a post 7 on either side of a metal wall 9, for example the wall of the transformer. The post 7 and the lower part of the cover 3 pass through the wall 9 through an orifice 11 drilled in that wall.

The cover 3 has substantially the shape of a tapered skirt and is made of porcelain or ceramic, as is the body 5. The various components are clamped on the post 7 by means of a nut 13 and a lock-nut 15. The impermeability of the assembly is ensured by elastomer gaskets 17, 19, 21, 23, and 25.

This conventional post-mounted device has the disadvantage of fragility resulting, most notably, from its ceramic cover, which withstands poorly vibrations and impacts and thus requires frequent replacement. In addition, this conventional post-mounted device is designed in such a way that the base 26 of the cover rests on the metal wall 9 by means of the sheet gasket 21. The relative flexibility of this gasket 21 allows a degree of pivoting motion of the cover in relation to the axis of the orifice 11, under the action of mechanical stresses generated on the post 7. This pivoting motion generates stresses on the porcelain in the cover 3 and can damage the latter. Furthermore, the pivoting of the cover forms gaps between the lifted side of the base 26 and the gasket 21 or the wall 9. This gap allows penetration of dust and other polluting agents into the device or the transformer.

Moreover, at least one lateral side of the gasket 21 is in contact with the surrounding air and external corroding agents, and another side is in contact with the internal dielectric, thereby causing the deterioration of this gasket and limiting the life of the unit.

In addition, post-mounted devices with ceramic covers are relatively bulky, for example in proximity to the wall, thereby requiring that orifices 11 having relative large diameters be drilled in this wall.

Figure 2:
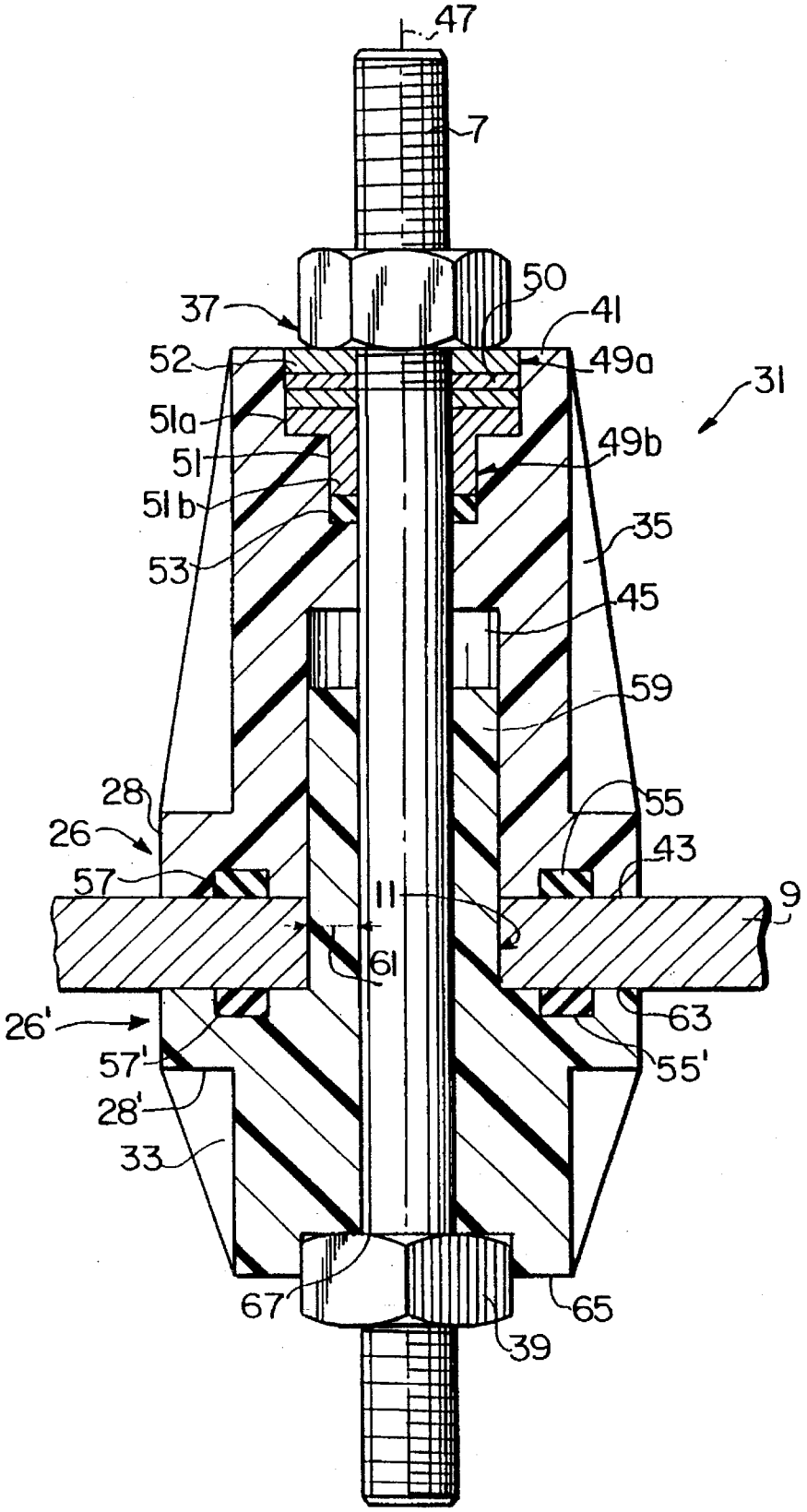
FIG. 2 is a raised view in cross section of a post-mounted device according to the invention.

FIG. 2 illustrates a preferred embodiment of the invention. The post-mounted device 31 shown in this figure also incorporates a body 33 positioned on a first side of a wall 9, and a cover 35 located on the other side thereof. The body 33 and the cover 35 are made of a plastic material exhibiting good mechanical strength under temperatures of up to approximately 250° C. To this end, use is made, in particular, of polybutylene terephthalate (PBT) or of a polyamide, in particular a polyamideimide (PAI). The body 33 and the cover 35 are arranged on the post 7, which passes through an orifice 11 drilled in the wall 9. The body 33 and the cover 35 are held together and against the faces of the wall by means of nuts 37, 39 screwed on the post 7.

The cover 35 has the overall shape of a cylinder incorporating an upper face 41 and a lower face 43, the latter being in contact with the wall 9. To protect the cover 35 and the body 33 against a pivoting motion and to protect the gaskets 57, 57' against corrosive agents coming from the outside and the inside, respectively, of the transformer, the base 26 of the cover 35 and the base 26' of the body 33 are fitted with protective means 28, 28'. These protective means take the form of an annular shoulder 28, 28' provided in the base 26, 26' of the cover 35 and of the body 33 and incorporating a circular groove 55, 55' capable of housing gaskets 57, 57', respectively. These annular shoulders 28, 28' act as blocks supported against the respective face of the wall 9. As a result, first, the pivoting motion of the cover and of the body is made very difficult, so that the post-mounted device is better protected against mechanical stresses; and second, the gaskets 57, 57' are protected against polluting agents by means of the annular shoulders 28, 28', with the result that impermeability of the device is achieved. In addition, the presence of the shoulder-shaped base 26, 26' ensures that the annular grooves 55, 55' will always retain a virtually constant size, thereby protecting the gaskets 57, 57' against excessive compression.

According to other advantageous features of the invention, the cover 35 incorporates, in the area of its lower face 43, a cylindrical cavity 45 whose axis merges with the axis 47 of the post and whose diameter is substantially equal to the diameter of the orifice 11 in the wall 9. The cover 35 further comprises, in the area of its upper face 41, a cylindrical opening 49 centered on the axis 47 of the cover or of the post 7 and having a depth sufficient to house a clamping washer 52, most notably one made of brass, and one or multiple elastic washers 50 made of steel, or, preferably, copper/beryllium, which prevent overheating for currents exceeding 1,000 A (as regards overheating resulting from currents of less than 1,000 A, use may be made of a steel washer), and which, because of their elasticity, make it possible to keep the gaskets 53, 57, 57' under pressure, even when the post 7 expands under heat. Preferably, the cylindrical opening 49 exists in the form of two juxtaposed coaxial cylinders **49*a* and 49*b*, i.e., a first, relatively large-diameter cylinder 49*a* located in the vicinity of the upper face of the cover and designed to house the washers 52, 50, and a second, smaller diameter cylinder 49*b* designed to house a spacer 51 and a gasket 53. The spacer 51 preferably has a radially extending portion 51*a* extending into the large diameter cylinder 49*a*, and an axially extending 51*b* extending into the second smaller diameter cylinder 49*b***. This spacer is made, most notably, of a plastic material reinforced with glass fibers, e.g., PBT containing 20% glass fibers, or of a polyamide (containing 40% glass fibers) or polyamideimide, as are the body and the cover.

The gasket 53 is preferably made of a carbon-containing fluorinated elastomer material capable of withstanding high temperatures (in particular, Viton, made by DuPont), teflon, or silicone. The gasket is mounted in a highly-tightened configuration, e.g., under a compression coefficient of 25%, in such a way that it is compressed radially between the cover 35 and the post 7, in order to impart impermeability of a very high quality, even when the post 7 expands under the effect of temperature.

It will be seen that the new design of the clamping washers 52, the elastic washers 50, and the spacer 51 makes it possible to protect the gasket 53 from dust and other polluting agents, since it is arranged on the inside of the cover 35, in the housing **49*b***.

The gaskets 57, 57' are made of materials having characteristics and coefficients of compression similar to those of the gasket 53 mentioned previously.

The body 33 of the post-mounted device according to the invention incorporates an annular cylindrical projection 59 extending upwardly from surface 63 of body 33 whose height is greater than the thickness of the wall 9, and whose inner diameter matches the diameter of the post 7, its outer diameter being substantially equal to the diameter of the orifice 11 in the wall. Thus, when the post-mounted device is mounted on either side of the wall, the external face of the projection 59 functions as an element which centers the body 33 and the cover 35 on the wall orifice 11. Moreover, the thickness 61 of the cylindrical projection 59 acts as an electrical insulator. To improve electrical insulation, the specialist can easily impart sufficient height and thickness to the cylindrical projection 59.

Furthermore, the body 33 incorporates, in the area of its lower wall 65, a hexagonal reinforcement 67, in which the clamping nut 39 is housed so as to prevent it from rotating. In addition, to lock the post 7 in place in relation to the nut 39, in order to facilitate the assembly and disassembly of the device, use is made of an anaerobic adhesive product, e.g., dimethylcrylate ester, between the post and the nut.

Figure 3A:
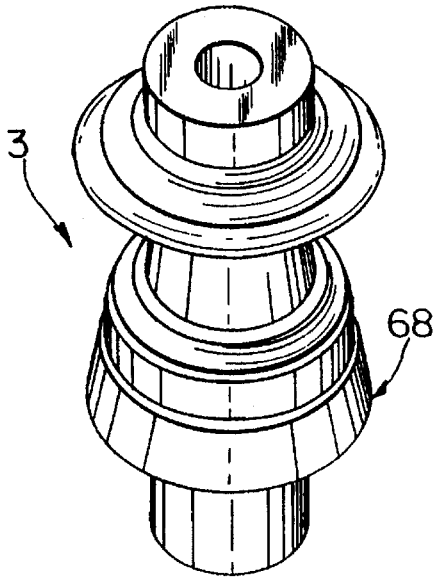
FIG. 3A is a perspective view of a post-mounted device fitted with a lip-incorporated spacer according to one embodiment of the invention.
Figure 3B:
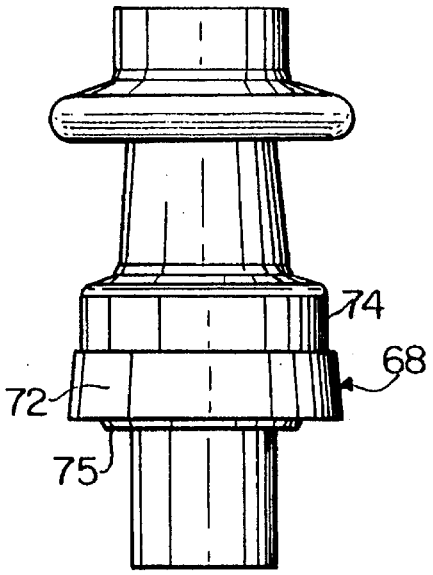
FIG. 3B is a raised view of the post-mounted device in FIG. 3A.
Figure 3C:
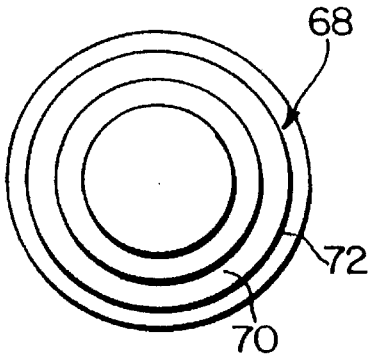
FIG. 3C is a plane view of the lip-incorporating spacer used in conjunction with the post-mounted device in FIG. 3A.

FIGS. 3A, 3B, and 3C illustrate a simplified variant of the invention, which is intended to adapt the post-mounted device protection means for use with a conventional post-mounted device equipped with a porcelain cover, thereby making it possible to impart certain advantageous features of the invention to conventional post-mounted devices or devices already in use. To this end, instead of comprising a block-shaped annular shoulder 28 as already explained with reference to FIG. 2, the cover 3 of the post-mounted device is connected to an attached block 68 designed to be inserted between the base 26 of the cover 3 and the wall 9 of the transformer (not shown). The block 68 exists as an attached spacer comprising a support tongue 70 extending parallel to the base of the cover 3 and a lip 72 extending substantially perpendicularly to the support tongue 70. The support tongue 70 jams the base of the cover against the wall of the transformer and absorbs the axial pressure resulting from the clamping of the post-mounted device against the wall 9. The lip 72 centers the cover 3 on the axis of the post (not shown) and clamps the base 26 of the cover 3 while being pressed elastically against the outer surface 74 of the base of the cover, thereby supplying a first impermeable protection against the penetration of polluting agents between the cover 3 and the wall 9. It should be noted that this impermeability can be enhanced by interposition of a standardized toric gasket 75 between the support tongue 70 and the base 26 of the cover, inside the supporting tongue 70. The spacer 68 is made of a material which withstands high temperatures and compression well, while possessing a degree of flexibility: e.g., nylon polyamide, polyethylene, or polyurethane. The flexibility of the lip 72 of the spacer 68 allows use of identical blocks for an entire range of porcelain post-mounted covers, thereby making it possible to compensate for the manufacturing tolerances of porcelain covers.

Accordingly, the post-mounted device according to the invention is designed to solve the problems of post-mounted devices according to the state of the art. In fact, the addition of block-shaped protective means makes it possible to increase substantially the resistance of the post-mounted device to mechanical stresses and to protect it against polluting agents, whether the component in question is a conventional device incorporating a porcelain cover or a plastic device.

The use of a suitable plastic material for manufacture of the body and cover allows still further improvement of the post-mounted device, while reducing its bulk. Furthermore, the special structure of the body and cover makes it possible, in this case, to ensure ease of assembly and self-centering on the post 7. Finally, all of the gaskets are arranged inside the body and cover of the device, but without contact with the surrounding air or corrosive agents, so that the impermeability of the device is substantially improved.

I claim:

1. A post mounted device for mounting over an electrical transformer output post extending through an orifice in a wall of an electrical transformer, said device comprising:

a body for positioning over the output post on a first side of the wall;

a cover for positioning over the output post on a second side of the wall, said cover having a central axis;

fastening means for clamping the wall between said body and said cover;

said cover having, at a first axial end of said cover, means for restricting pivotal motion of said cover relative to the wall and means for sealing said cover against the wall, with said cover further including a stepped cylindrical opening centered on said cover central axis and extending into said cover from a second axial end of said cover opposite from said first axial end, with said stepped cylindrical opening having a large diameter portion and a small diameter portion, said large diameter portion being closer to said second axial end than said small diameter portion;

an annular gasket positioned within said small diameter portion of said stepped cylindrical opening for sealing radially against the output post;

a stepped spacer positioned partially within said large diameter portion and partially within said small diameter portion for applying a compressive load against said annular gasket; and an elastic washer positioned within said large diameter portion for applying a compressive load against said stepped spacer.

2. The post-mounted device of claim 1 wherein said cover and said body are made from a plastic material, said means for restricting pivotal motion comprises an annular shoulder at said first axial end of said cover, and said means for sealing said cover against the wall comprises an annular groove formed within said annular shoulder and a gasket positioned within said annular groove.

3. The post-mounted device of claim 2, wherein said plastic material is a polybutylene terephthalate.

4. The post-mounted device of claim 2, wherein said plastic material is a polyamide or a polyamideimide.

5. The post-mounted device of claim 1, wherein said cover comprises a cylindrical cavity extending in from said first axial end of said cover, and wherein said body comprises an annular cylindrical projection which is inserted within said cylindrical cavity of said cover for centering said body and said cover relative to the orifice in the wall of the electrical transformer.

6. The post-mounted device of claim 1, wherein said elastic washer is made of copper-baryllium.

7. The post-mounted device of claim 1, wherein said stepped spacer includes a radially extending portion positioned within said large diameter portion of said stepped cylindrical opening, and an axially extending portion positioned within said small diameter portion of said stepped cylindrical opening.

8. The post-mounted device of claim 1, wherein said stepped spacer is made of polybutylene terephthalate reinforced with glass fibers.

9. The post-mounted device of claim 1 wherein said annular gasket is made of a carbon containing, fluorinated elastomer material, teflon, or silicone.

10. The post-mounted device of claim 1, wherein said cover is made from porcelain, and said means for restricting pivotal motion of said cover relative to the wall comprises a separate spacer for positioning between said cover and the wall.

11. The post-mounted device of claim 10, wherein the separate spacer comprises a radial portion for positioning between said first axial end of said cover and the wall, and an axially extending portion for clamping on an outer peripheral surface of said cover.

* * * * *